US006336434B1

(12) United States Patent
Shomura et al.

(10) Patent No.: US 6,336,434 B1
(45) Date of Patent: Jan. 8, 2002

(54) ENGINE UNIT OF OUTBOARD MOTOR

(75) Inventors: Nobuyuki Shomura; Yukihiro Yoshikawa; Kazuo Mineno; Takeshi Toyama, all of Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/574,072

(22) Filed: May 18, 2000

(30) Foreign Application Priority Data

May 18, 1999 (JP) ..... 11-137556

(51) Int. Cl.[7] ..... F02F 7/00

(52) U.S. Cl. ..... 123/195 P; 123/179.29; 123/192.1

(58) Field of Search ..... 123/195 P, 196 W, 123/192.1, 192.2, 179.29, 406.56, 90.31; 440/85; 74/572; 277/591

(56) References Cited

U.S. PATENT DOCUMENTS 4,695,261 A * 9/1987 Broughton et al. ..... 440/61
5,159,916 A * 11/1992 Isogawa ..... 123/602
5,186,133 A * 2/1993 Watanabe et al. ..... 123/179.14
5,282,444 A * 2/1994 Ito et al. ..... 123/192.2
5,553,586 A * 9/1996 Koishikawa et al. ..... 123/195 P
5,678,519 A * 10/1997 Nakamura ..... 123/413
5,722,360 A * 3/1998 Tsunoda et al. ..... 123/195 P
5,980,341 A * 11/1999 Mishima et al. ..... 440/88
6,029,540 A * 2/2000 Tsunoda et al. ..... 74/595
6,053,155 A * 4/2000 Kashima ..... 123/599
6,079,384 A * 6/2000 Koishikawa et al. ..... 123/195 P
6,186,844 B1 * 2/2001 Yonezawa et al. ..... 440/52

FOREIGN PATENT DOCUMENTS

JP 317935 * 12/1998

* cited by examiner

*Primary Examiner*—Willis R. Wolfe
*Assistant Examiner*—Hai H. Huynh
(74) *Attorney, Agent, or Firm*—Oblon, Spivak, McClelland, Maier & Neustadt, P.C.

(57) ABSTRACT

An engine unit of an outboard motor comprises an engine body, a crank case in which a crankshaft is vertically perpendicularly arranged in a usable mounted state of the outboard motor, a cylinder block which is disposed to a rear side of the crank case and in which cylinders are arranged, a cylinder head disposed to a rear side of the cylinder block, a magnet device mounted to a top end portion of the crankshaft projecting upward and comprising a stator and a flywheel to which a rotor is integrally formed. In the engine unit, the crankshaft is supported by a bearing boss disposed to a mating portion of the cylinder block and the crank case through a bearing means and an oil seal is disposed between the bearing boss and the bearing means, and the magnet device is mounted to the engine body through the stator through a mounting portion. A diameter of the mounting portion of the stator is to be larger than an outer diameter of the oil seal.

8 Claims, 8 Drawing Sheets

ENGINE UNIT OF OUTBOARD MOTOR

BACKGROUND OF THE INVENTION

1. Field of the Invention

The present invention relates to an engine unit of an outboard motor particularly provided with an improved structure of a magneto device.

2. Prior Art

In an outboard motor, it is common to vertically dispose a crankshaft in an engine. The crankshaft is supported in the engine by a bearing, and lubricating oil is pumped to the bearing in a certain arrangement. An oil seal is provided above the bearing so that the lubricating oil will not leak outside from the bearing which supports an upper end of the crankshaft. The oil seal is mounted to the engine using a separate seal housing in many cases.

Meanwhile, in order to absorb variation in rotation of the engine and to deal with abrupt variation in load at the time of shifting, a rotation member having great moment of inertia is provided on an axis of revolution of the engine, usually on the crankshaft.

In the case of the engine unit of the outboard motor, the upper end of the crankshaft is usually projected above the engine body in an usual state to be mounted to a hull, for example, and the rotation member having great moment of inertial, i.e., a flywheel is provided on this projected portion. The flywheel constitutes a portion of a magneto device. In this case, it is a common method to integrally form the flywheel with a rotor constituting a part of the magneto device, and to fix a stator to which an electric generating coil is mounted to the seal housing which also serves as a mounting member of the stator. A recoil starter apparatus for manually starting the engine is provided above the magneto device in some cases.

A factor which determines a height of the outside shape of the outboard motor is a structural member provided on an upper portion of the engine, which, in generally, corresponds to the above-described magneto device and the recoil starter device.

Such location is not preferable because the height of the structural member is increased and the entire outboard motor is increased in size. Further, the shape of an engine cover must be considered in accordance with the structural member, and flexibility of styling is limited.

Further, the flywheel having great mass is supported in a cantilever manner by the bearing which supports the upper end of the crankshaft. Therefore, as the projecting length of the crankshaft outside from the engine is increased, even a slight deviation in revolution balance generated by the flywheel increases vibration, and this becomes a great burden to the crankshaft and the bearing. Even slight deviation in revolution balance generated by the engine and the crankshaft applied to an end of the crankshaft functions as a great moment, and this moment becomes a great burden to the crankshaft and the bearing and also becomes a factor for increasing the vibration.

It is not preferable to increase the crankshaft and the bearing in size and to change the material and producing method in order to prevent the vibration and to enhance the durability of the respective constitutional members.

SUMMARY OF THE INVENTION

The present invention has been accomplished in view of the above circumstances, and it is an object of the invention to provide an engine unit of an outboard motor capable of making compact the engine unit in size by shortening a projecting length of a crankshaft outward of an engine with a simple structure.

This and other object can be achieved according to the present invention by providing an engine unit of an outboard motor comprising:

an engine body;

a crank case in which a crankshaft is vertically perpendicularly arranged in a usable mounted state of the outboard motor;

a cylinder block which is disposed to a rear side of the crank case and in which cylinders are arranged;

a cylinder head disposed to a rear side of the cylinder block, the crank case, the cylinder block and the cylinder head being disposed in the engine body; and a magnet device mounted to a top end portion of the crankshaft projecting upward and comprising a stator and a flywheel to which a rotor is integrally formed, the crankshaft being supported by a bearing boss disposed to a mating portion of the cylinder block and the crank case through a bearing means and an oil seal is disposed between the bearing boss and the bearing means, the magnet device being mounted to the engine body through the stator through a mounting portion, wherein a diameter of the mounting portion of the stator is larger than an outer diameter of the oil seal.

In a preferred embodiment, the stator is directly mounted to the engine body. The engine body is formed with a hole through which the stator is mounted and the hole has a depth deeper than a position of a mounting portion of the oil seal.

The engine unit may further comprise a crank angle detecting sensor disposed to an upper surface of the engine body and a mounting boss for mounting the sensor disposed to be deviated sideways from a center line of the cylinder of the engine, the sensor being mounted to the mounting boss in an upside-down attitude.

The engine unit may further comprise a starter motor, a mounting boss for mounting the starter motor to the engine body, and a crank angle detecting sensor which is mounted to a boss formed to the starter motor mounting boss.

The engine unit may further comprise a cam shaft driving mechanism which is disposed below the bearing means.

As explained above, in the engine unit of the outboard motor of the present invention, the crankshaft is vertically disposed in the engine (engine body), an upper end of the crankshaft is projected upward of the engine as a projection, and the projection is provided with the magneto device, a bearing boss above a bearing which supports an upper end of the crankshaft is provided with an oil seal, a diameter of a mounting portion of a stator constituting the magneto device to the engine is set greater than an outer diameter of the oil seal. Therefore, the stator can be disposed outward of the oil seal, the projecting length of the crankshaft outside of the engine is shortened, and the entire height of the engine is lowered.

Further, since the stator is directly mounted to the engine, the seal housing which was necessary in the conventional structure can be eliminated, the number of parts is reduced, the projecting length of the crankshaft outward of the engine is shortened, and the entire height of the engine is lowered.

Further, since the engine is formed with a hole for mounting the stator, and a depth of the hole is set deeper than a position of a mounting portion of the oil seal, the projecting length of the crankshaft outward of the engine is shortened, and the entire height of the engine can be reduced.

Furthermore, the engine is provided at its upper surface with the crank angle detecting sensor, the boss for mounting the sensor is disposed to be deviated sideways from the center line of the cylinder of the engine, and the sensor is mounted to the boss upside down. Therefore, the sensor does not interfere with the cooling water passage formed around the cylinder.

Further, the engine includes the starter motor, the boss for mounting the starter motor is formed on the engine, and the boss for mounting the motor is provided with another boss for mounting the other sensor. Therefore, the weight of the engine unit is reduced and the supporting rigidity thereof can be ensured sufficiently.

Furthermore, the engine includes the cam shaft driving mechanism, and the camshaft driving mechanism is disposed at a position lower than the bearing which supports the upper end of the crankshaft. Therefore, the distance between the flywheel and the bearing can be shortened.

The nature and further features of the present invention will be made more clear from the following descriptions made with reference to the accompanying drawings.

DESCRIPTION OF THE PREFERRED EMBODIMENTS

Preferred embodiments of the present invention will be explained hereunder with reference to the accompanying drawings.

Figure 1:
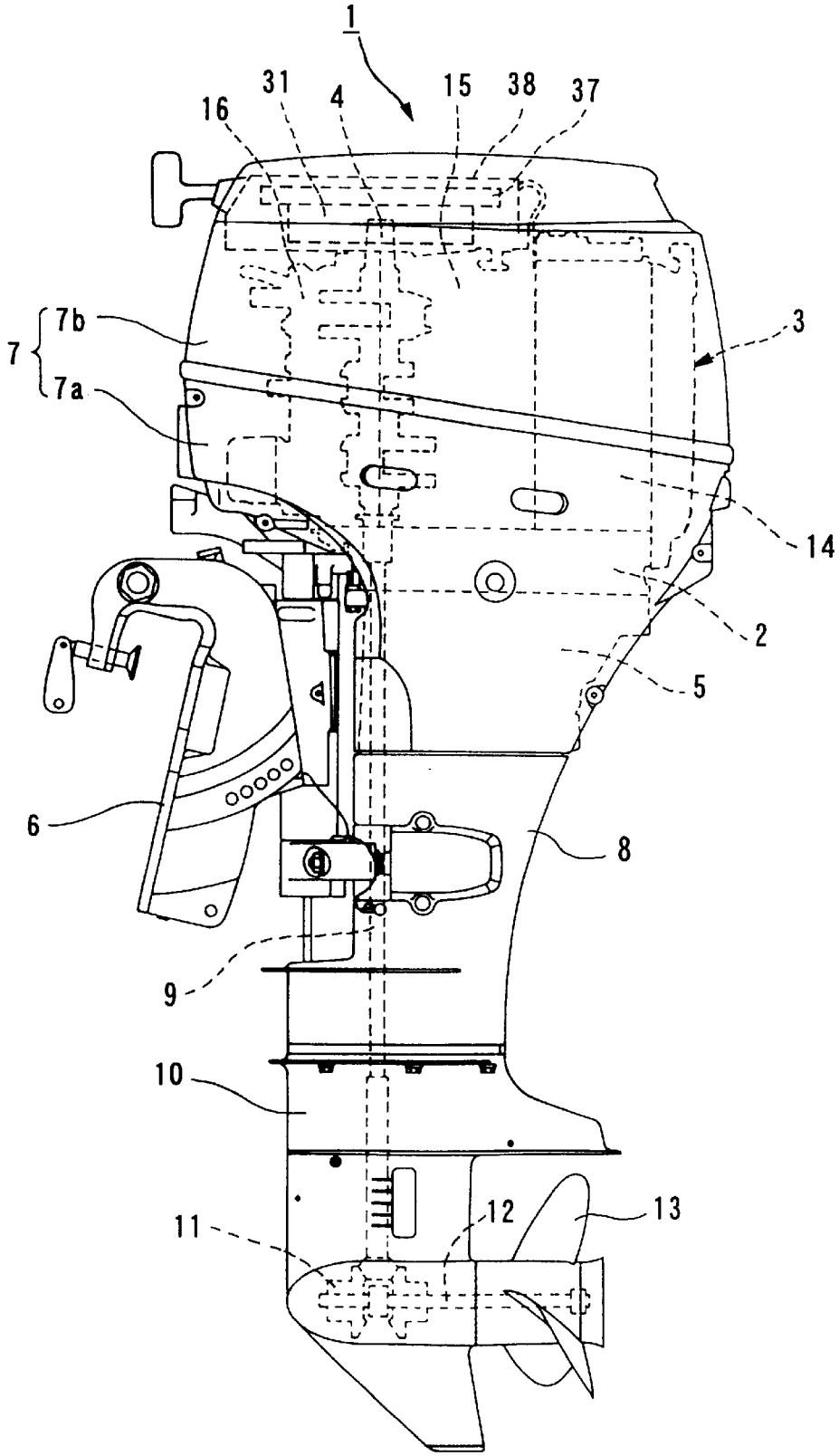
FIG. 1 is a left side view of an outboard motor showing a first embodiment according to the present invention.

FIG. 1 is a left side view showing a first embodiment of an outboard motor to which the present invention is applied.

As shown in FIG. 1, the outboard motor 1 includes an engine holder 2, and an engine (engine unit including an engine body) 3 is disposed above the engine holder 2. The engine 3 is a vertical type engine in which a crankshaft 4 is disposed substantially vertically. An oil pan 5 is disposed below the engine holder 2, a bracket 6 is mounted to the engine holder 2 for example, and the outboard motor 1 is mounted to a transom of a hull, not shown, through the bracket 6. Further, it is to be noted that the description of the present invention made hereunder is substantially made with reference to the state of the outboard motor 1 mounted to the hull as illustrated in FIG. 1.

Peripheries of the engine 3, the engine holder 2 and the oil pan 5 of the outboard motor 1 are covered by an engine cover 7. The engine cover 7 is divided into lower and upper two portions, i.e., into a lower cover section 7*a* for covering the peripheries of a lower portion of the engine 3, the engine holder 2 and the oil pan 5 and an upper cover section 7*b* for covering an upper portion of the engine 3.

A drive shaft housing 8 is disposed in a lower portion of the oil pan 5. A drive shaft 9 is disposed substantially vertically in the engine holder 2, the oil pan 5 and the drive shaft housing 8, and an upper end of the drive shaft 9 is connected to a lower end of the crankshaft 4. The drive shaft 9 extends downward in the drive shaft housing 8 for driving a propeller 13 through a bevel gear 11 and a propeller shaft 12 in a gear case 10 provided in a lower portion of the drive shaft housing 8.

Figure 2:
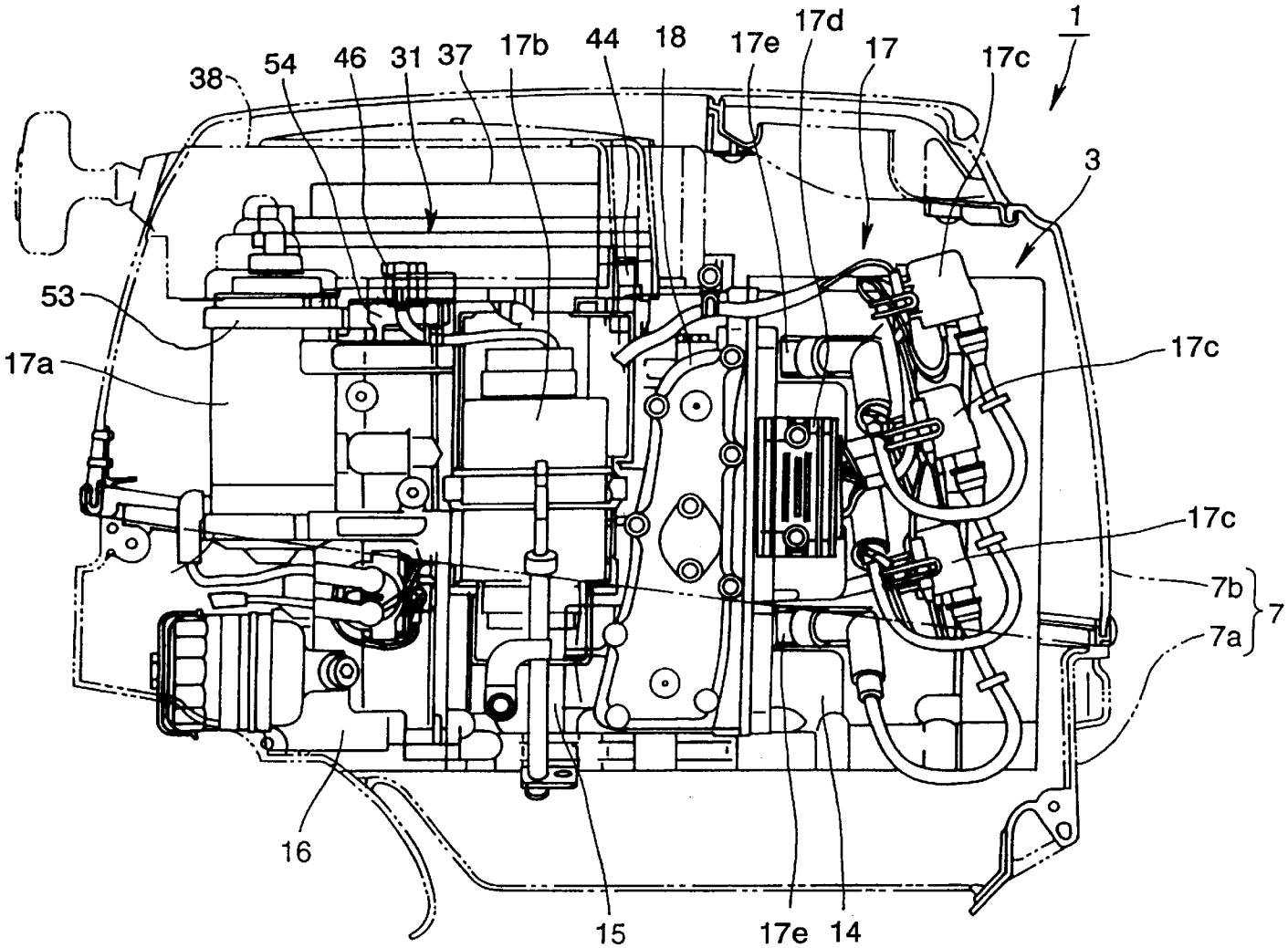
FIG. 2 is an enlarged side view of an engine unit of the outboard motor shown in FIG. 1.
Figure 3:
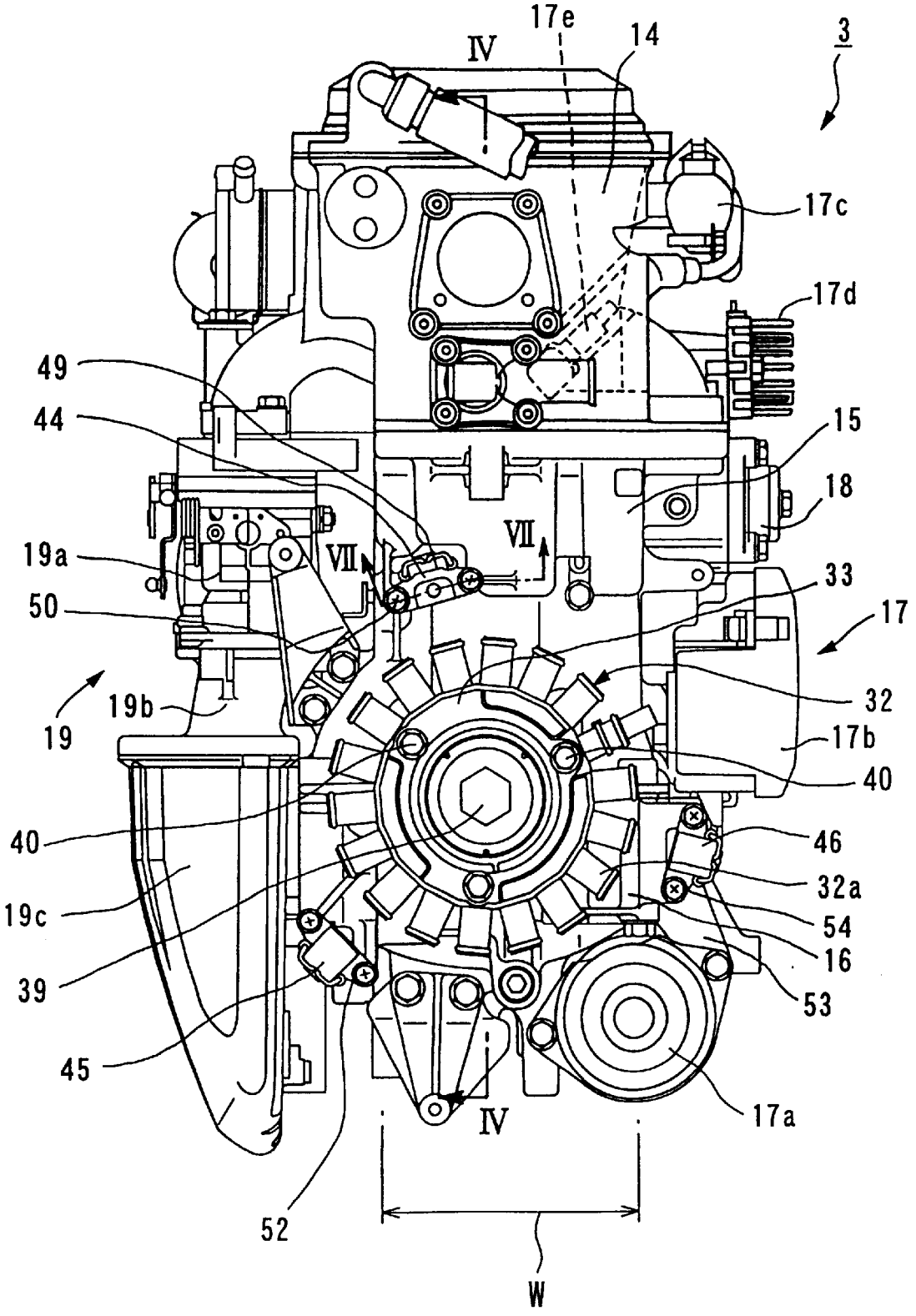
FIG. 3 is a plan view of the engine shown in FIG. 2.

With reference to FIGS. 1, 2 and 3, the engine 3 mounted in the outboard motor 1 is a water-cooled four-stroke-cycle three-cylinder engine comprising a combination of, e.g., a cylinder head 14, a cylinder block 15 and a crankcase 16.

The cylinder block 15 is disposed at the forefront of the engine 3, i.e., behind (right side) of the crankcase 16 disposed at the leftmost position in FIGS. 1 and 2. The cylinder head 14 is disposed behind the cylinder block 15.

As shown in FIG. 2, disposed on the left side surface of the engine 3 are a starter motor 17*a*, an electrical equipment box 17*b* in which control electrical equipment, not shown, is accommodated, ignition coils 17*c*, electrical equipment parts 17 such as a rectifier and a regulator 17*d*, and an ignition plug 17*e*, and an exhaust system part 18. Disposed on the right side surface of the engine 3 are intake system parts 19 such as a carburetor 19*a*, an intake pipe 19*b* and silencer 19*c*.

Figure 4:
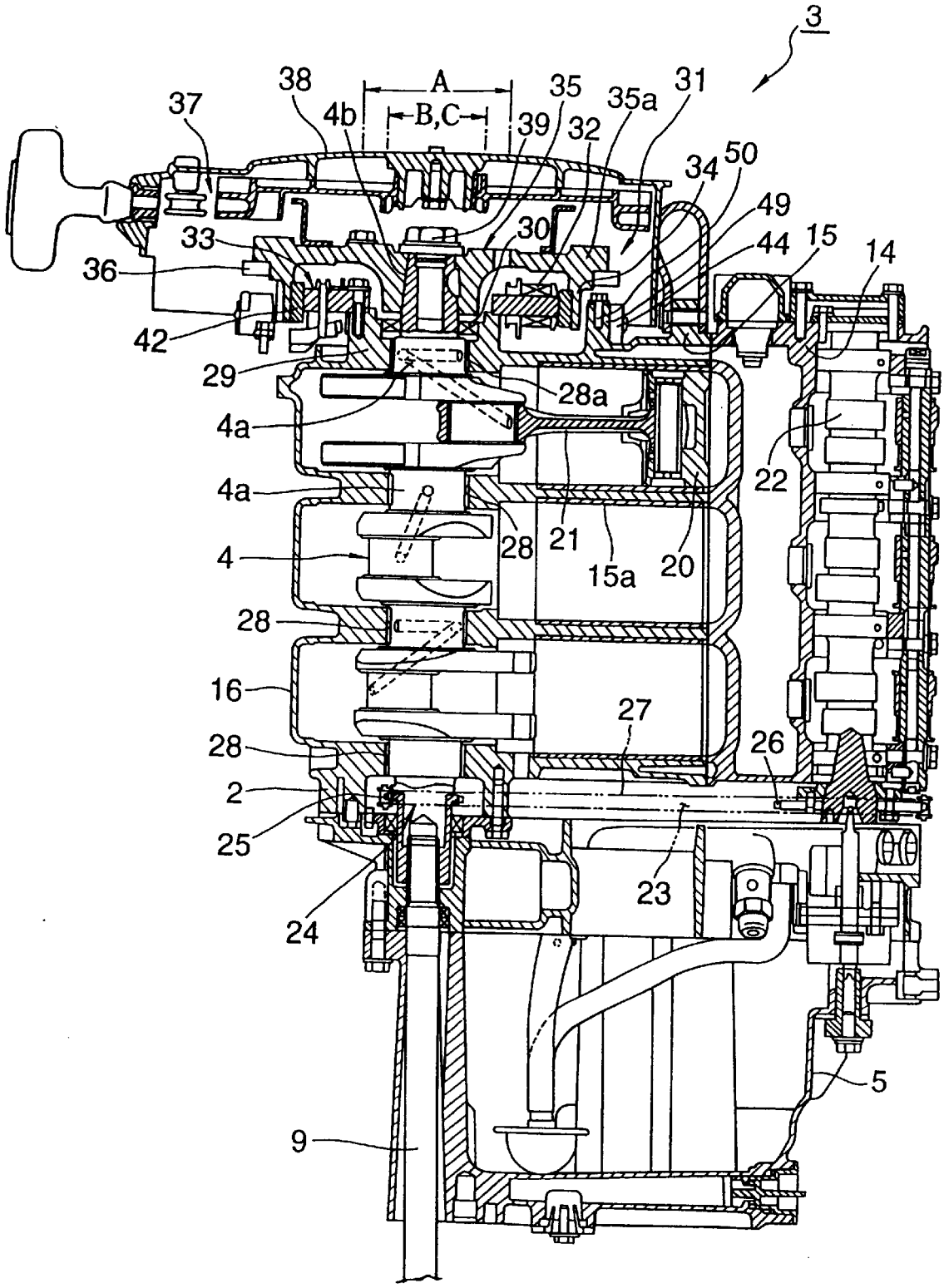
FIG. 4 is a cross sectional view taken along the line IV—IV in FIG. 3.

FIG. 4 is a cross sectional view taken along the line IV—IV in FIG. 3. As shown in FIG. 4, a cylinder 15*a* is substantially horizontally formed in the cylinder block 15 of the engine 3, and a piston 20 is inserted in the cylinder 15*a* slidably in the axial direction of the crankshaft 15*a*. The piston 20 and the crankshaft 4 are connected to each other by a connecting rod 21 so that reciprocating stroke of the piston 20 is converted into rotational motion of the crankshaft 4. Although the piston 20 and the connecting rod 21 are illustrated in only one cylinder 15*a* in FIG. 4, pistons and connecting rods, not shown, are disposed also in other cylinders 15*a* in the similar manner.

Intake/exhaust valves, not shown, for opening and closing supply/discharge ports, not shown, are disposed in the cylinder head 14, and a cam shaft 22 for opening and closing these valves is disposed in a rear portion of the cylinder head 14.

A cam chain chamber 23 is formed in a space between a lower portion of the engine 3 and an upper surface of the engine holder 2. A cam shaft driving mechanism 24 for transmitting rotation of the crankshaft 4 to the cam shaft 22 to rotate the latter is provided in the cam chain chamber 23. The cam shaft driving mechanism 24 is driven by a chain for example and comprises a cam drive sprocket 25 provided on a portion of the crankshaft 4 projecting downward of the engine 3, a cam driven sprocket 26 provided at the lower end of the cam shaft 22 projecting downward of the engine 3 similarly, and a timing chain 27 wound around these sprockets 25 and 26.

A journal 4a of each of the crankshafts 4 is pivotally supported by a bearing boss 29 formed on a juncture (mating portion) between the cylinder block 15 and the crankcase 16 through a bearing 28, i.e., through a metal bearing in the present embodiment. The upper end of the crankshaft 4 projects upward of the engine 3 as a projection 4*b*, and an oil seal 30 is provided on a bearing boss 29 located between this projection 4*b* and the bearing 28*a* supporting the journal 4*a* of the upper end of the crankshaft 4.

Figure 5:
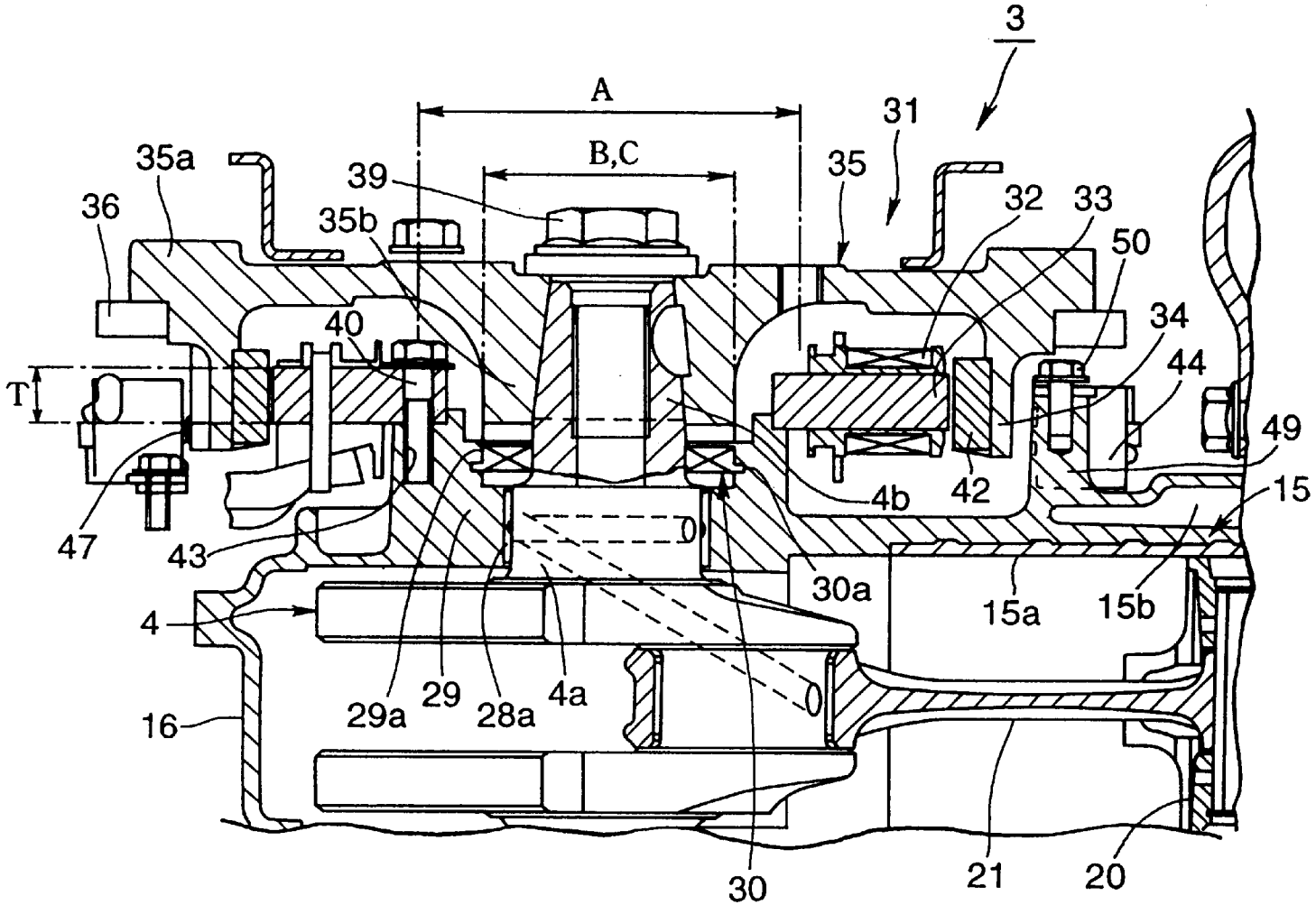
FIG. 5 is an enlarged vertical sectional view of an upper end projecting portion of a crankshaft.

FIG. 5 is an enlarged vertical cross sectional view of the projection 4*b* on the upper end of the crankshaft. As shown in FIG. 5, the oil seal 30 is formed at its outer peripheral surface with a falling-out preventing flange 30*a*. The falling-out preventing flange 30*a* is fitted and fixed to a seal groove 29*a* which is a mounting portion of the oil seal 30 formed in the bearing boss 29 of the juncture between the cylinder block 15 and the crankcase 16 when the cylinder block 15 and the crankcase 16 are connected.

The projection 4*b* of the crankshaft 4 is provided with a magneto device 31. The magneto device 31 comprises a stator 33 to which an electric generating coil 32 is mounted, and a flywheel 35 integrally formed with a rotor 34. The flywheel 35 is formed at its outer periphery with a ring gear 36 which is operatively connected to the stator motor 17*a*, a recoil starter apparatus 37 (see FIGS. 1 and 2) is provided above the magneto device 31, and both the apparatus 31 and 37 are covered with a recoil cover 38.

Figure 6:
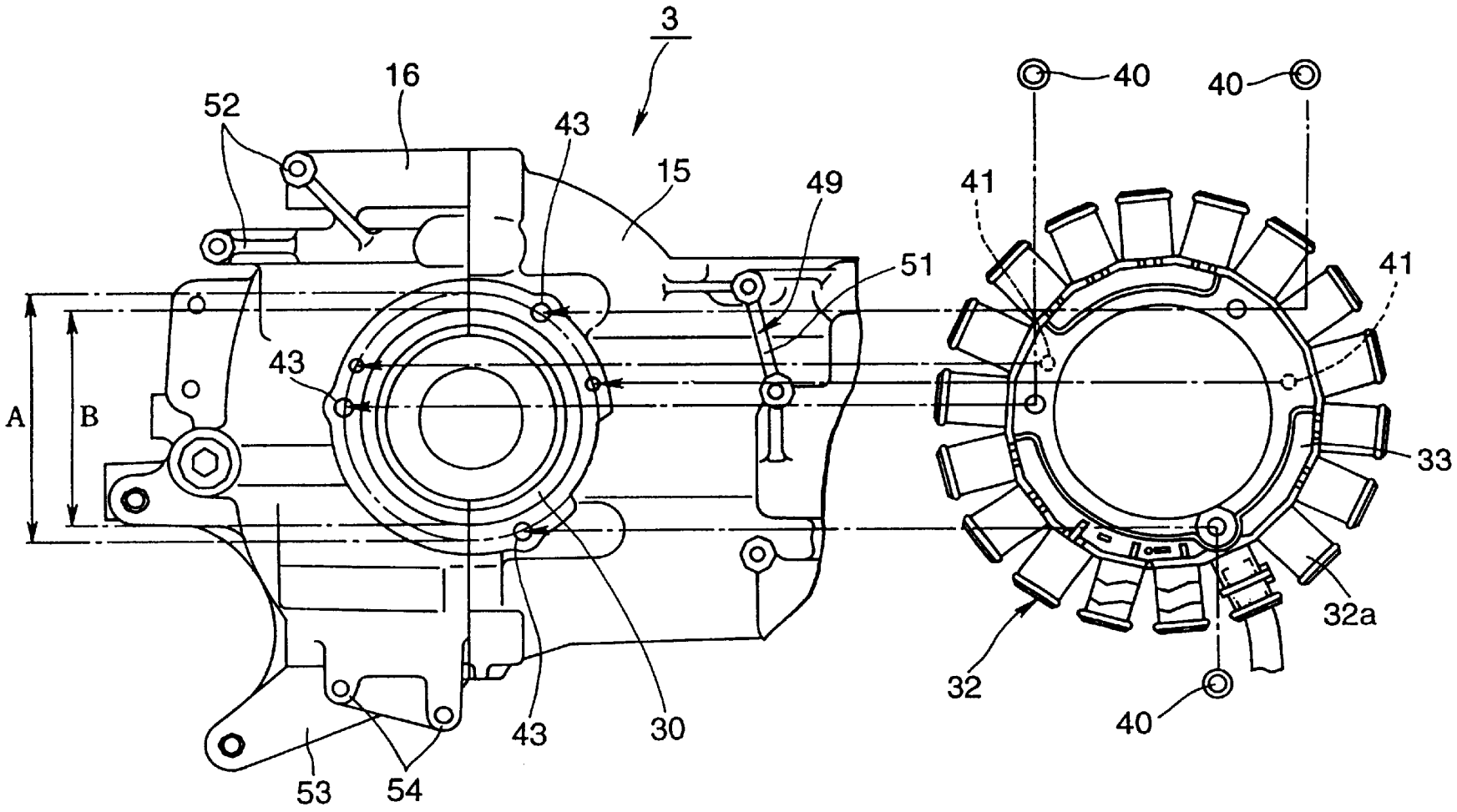
FIG. 6 is a plan view of a portion of the engine.

The flywheel 35 integrally formed with the rotor 34 is fitted to the projection 4*b* of the crankshaft 4 and is fixed to the crankshaft 4 by a bolt 39 such that the flywheel 35 rotates in unison with the crankshaft 4. The fitting portion between the projection 4*b* and the flywheel 35 is formed into a tapered shape. Further, as shown in FIG. 6, the stator 33 is directly fixed to the cylinder block 15 and the crankcase 16 by a bolt 40 or the like. A knock pin 41 may be used for positioning the stator 33. A magnet 42 is provided on an inner surface of the rotor 34 at a position opposed to the electric generating coil 32 of the stator 33.

As shown in FIGS. 4 to 6, a diameter A of a mounting portion of the stator 33 to the cylinder block 15 and the crankcase 16 is set greater than an outer diameter B of the oil seal 30 (see FIGS. 5 and 6), and the stator 33 is disposed outside of the oil seal 30. A depth of a hole 43 for a bolt 40 for fixing the stator 33 formed on the cylinder block 15 and the crankcase 16 is set deeper than a position of a seal groove 29*a* for mounting the oil seal 30.

As shown in FIGS. 3 and 4, a plurality of (three in the present embodiment) crank angle detecting sensors 44, 45 and 46 (simply, sensors, hereinafter) are provided on an upper surface of the engine 3. These sensors 44, 45 and 46 detect the passing timing of a projection 47 (see FIG. 5) disposed on a reference crank angle position on an outer periphery of the flywheel 35 to judge the ignition timing of the ignition plug 17*e*. These sensors 44, 45 and 46 are disposed at substantially equal distances from one another along the outer periphery of the flywheel 35.

Figure 7:
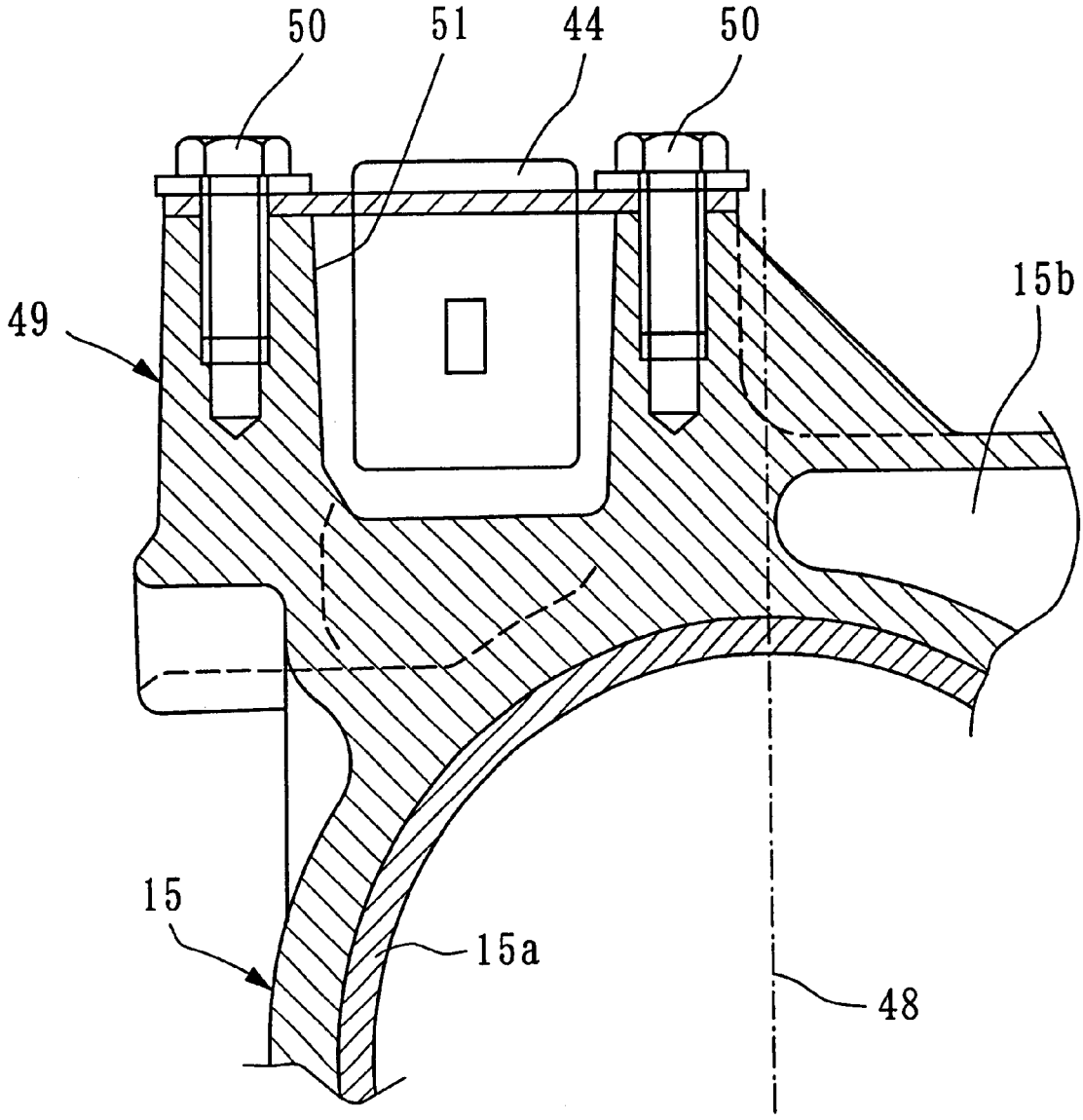
FIG. 7 is a cross sectional view taken along the line VII—VII in FIG. 3.

FIG. 7 is a cross sectional view taken along the line VII—VII in FIG. 3. As shown in FIGS. 3, 6 and 7, of the three sensors 44, 45 and 46, the sensor 44 provided on the upper surface of the cylinder block 15 is deviated sideways from a center line 48 of the cylinder 15*a*, and integrally formed with the cylinder block 15 and fixed to the sensor mounting boss 49 projecting upward by means of two bolts 50 for example. A portion of the sensor mounting boss 49 between its female screws is downwardly recessed to form a recess 51, and the sensor 44 is mounted in the recess 51 upside down.

On the other hand, of the three sensors 44, 45 and 46 provided on an upper surface of the engine 3, the sensors 45 and 46 disposed outer side from the width W (see FIG. 3) of the cylinder block 15 are mounted to a sensor mounting boss 54 integrally formed on a motor mounting boss 53 integrally formed on the crankcase 16 for supporting the starter motor 17*a* and the sensor mounting boss 52 integrally formed on the crankcase 16, for example.

Next, operation of the first embodiment will be explained.

When the camshaft driving mechanism 24 is disposed on the side of the lower end of the crankshaft 4, the oil seal 30 is provided on the bearing boss 29 between the projection 4*b* on the upper end of the crankshaft 4 and the bearing 28*a* supporting the journal 4*a* of the upper end of the crankshaft 4, the diameter A of the mounting portion of the stator 33 constituting the magneto device 31 to the engine 3 (cylinder block 15 and the crank case 16) is set greater than the outer diameter B of the oil seal 30, and the stator 33 is disposed outer side of the oil seal 30. With this layout, since the fixing bolt 40 for fixing the stator 33 does not interfere with the oil seal 30 and thus, a seal housing which also functions as a mounting member of the stator 33 which was necessary in the prior art can be eliminated. As a result, the stator 33 can be directly fixed to the engine 3, and the entire height of the engine 3 can be reduced by the same length as the height of the seal housing, the outboard motor 1 can be reduced in size, the weight of the entire outboard motor 1 can be reduced, and the flexibility in styling of the engine cover 7 is enhanced. Further, since it is possible to shorten the crankshaft 4 by the same length as the height of the sealing housing, load that the vibration caused by deviation in rotation balance generated from the flywheel 35, and moment caused by deviation in rotation balance generated from the engine 3 and the crankshaft 4 apply to the crankshaft 4 and the bearing 28*a* is reduced, the reliability of the engine 3 is enhanced, and the durability is extended.

Further, since the diameter A of the mounting portion of the stator 33 to the engine 3 is set to be greater than the outer diameter B of the oil seal 30, it is possible to increase the diameters of the electric generating coil 32 mounted to the stator 33 and the flywheel 35 integrally formed with the rotor 34. For example, by increasing the outer diameter of the flywheel 35 as compared with the conventional structure, a peripheral speed of the projection 47 disposed in the reference crank angle position of the outer periphery of the flywheel 35 is increased as compared with the conventional structure, and it is possible to detect a stable reference signal from lower engine revolution number. The starting performance and stability in a low revolution region of the engine 3 can be enhanced.

Further, by increasing the outer diameter of the flywheel 35 as compared with the conventional structure, a mass 35*a* can easily be mounted at outer side of the flywheel 35 in the diametrical direction, and it is possible to increase the moment of inertia as compared with the conventional structure even if the same weight is added, and absorbing ability of revolution variation of the engine 3 is enhanced.

Furthermore, by increasing the outer diameter of the flywheel 35 as compared with the conventional structure, a peripheral speed of the magnet 42 mounted to the rotor 34 is also increased, and the electric generating amount is increased. If the required electric generating amount is the same as that of the conventional structure, the length of the magnet 42 can be shortened, the flywheel 35 can be made thinner, i.e., its height can be lowered.

Further, by increasing the outer diameter of the stator 33 as compared with the conventional structure, if the number of poles 32*a* of the electric generating coil 32 is the same as that of the conventional structure, a distance between poles 32*a* is increased, and the number of windings of a coil wire, not shown, can be increased. As a result, the electric generating amount can be increased. If the required electric generating amount is the same as that of the conventional structure, the thickness T of the core of the electric generating coil 32 can be reduced, the stator 33 can be made thinner, i.e., its height can be lowered.

Further, since the diameter A of the mounting portion of the stator 33 to the engine 3 is set greater than the outer diameter B of the oil seal 30, and the stator 33 is directly fixed to the engine 3, a contact area of the stator 33 with the engine 3 is increased, and it is easy to transmit the heat generated at the time of generation of electric power to the engine 3. As a result, heat resistance of the coil wire is enhanced, and the reliability of the magneto device 31 is enhanced.

Furthermore, it is possible to lower the heat resistance of the coil wire, resulting in the cost reduction.

Further, since the diameter A of the mounting portion of the stator 33 to the engine 3 is set greater than the outer diameter B of the oil seal 30, a diameter C of the boss 35*b* for mounting the flywheel 35 to the crankshaft 4 can be increased as compared with the conventional structure. As a result, fastening torque of the bolt 39 for fixing the flywheel 35 to the crankshaft 4 can be increased, and a tapering length of the fitting portion between the crankshaft 4 and the flywheel 35 can be shortened, and the height of the flywheel 35 can be reduced.

Further, since the diameter A of the mounting portion of the stator 33 to the engine 3 is set greater than the outer diameter B of the oil seal 30, a diameter of the crankshaft 4 can be increased as compared with the conventional structure. As a result, since a surface area of the tapered portion is increased, the tapering length can be shortened, and the height of the flywheel 35 can be reduced.

On the other hand, since the diameter A of the mounting portion of the stator 33 to the engine 3 is set greater than the outer diameter B of the oil seal 30, the outer diameter of the flywheel 35 is also increased, and its height is also reduced. Therefore, if the sensor 44 is mounted upside down, the height of the sensor 44 is reduced so as not to be interfered with the flywheel 35.

If the sensor 44 is disposed on the center line 48 of the cylinder 15*a*, a mounting depth of the sensor 44 is limited so as not to be interfered with a cooling water passage 15*b* (see FIG. 7) formed around the cylinder 15*a*, but if the sensor 44 is deviated sideways from the center 48 of the cylinder 15*a* and mounted upside down, it is possible to reduce the height of the sensor 44 only by making shallow a portion of the cooling water passage 15*b* corresponding to the immediately below the sensor 44, and the height of the sensor 44 is further lowered so as not to be interfered with the flywheel 35. The sensors 45 and 46 disposed outer side of the width W of the cylinder block 15 are overhanging from the engine 3, but if the sensor mounting boss 54 is provided on the motor mounting boss 53 formed in the crankcase 16, it is possible to reduce the weight as compared with a boss 52 which is formed singly, and sufficient supporting rigidity can be ensured.

Further, since the cam shaft driving mechanism 24 is disposed at a height lower than the bearing 28*a* which supports the upper end of the crankshaft 4, it is possible to shorten the distance between the flywheel 35 and the bearing 28*a* , and a load applied to the crankshaft 4 and the bearing 28 can be reduced.

Figure 8:
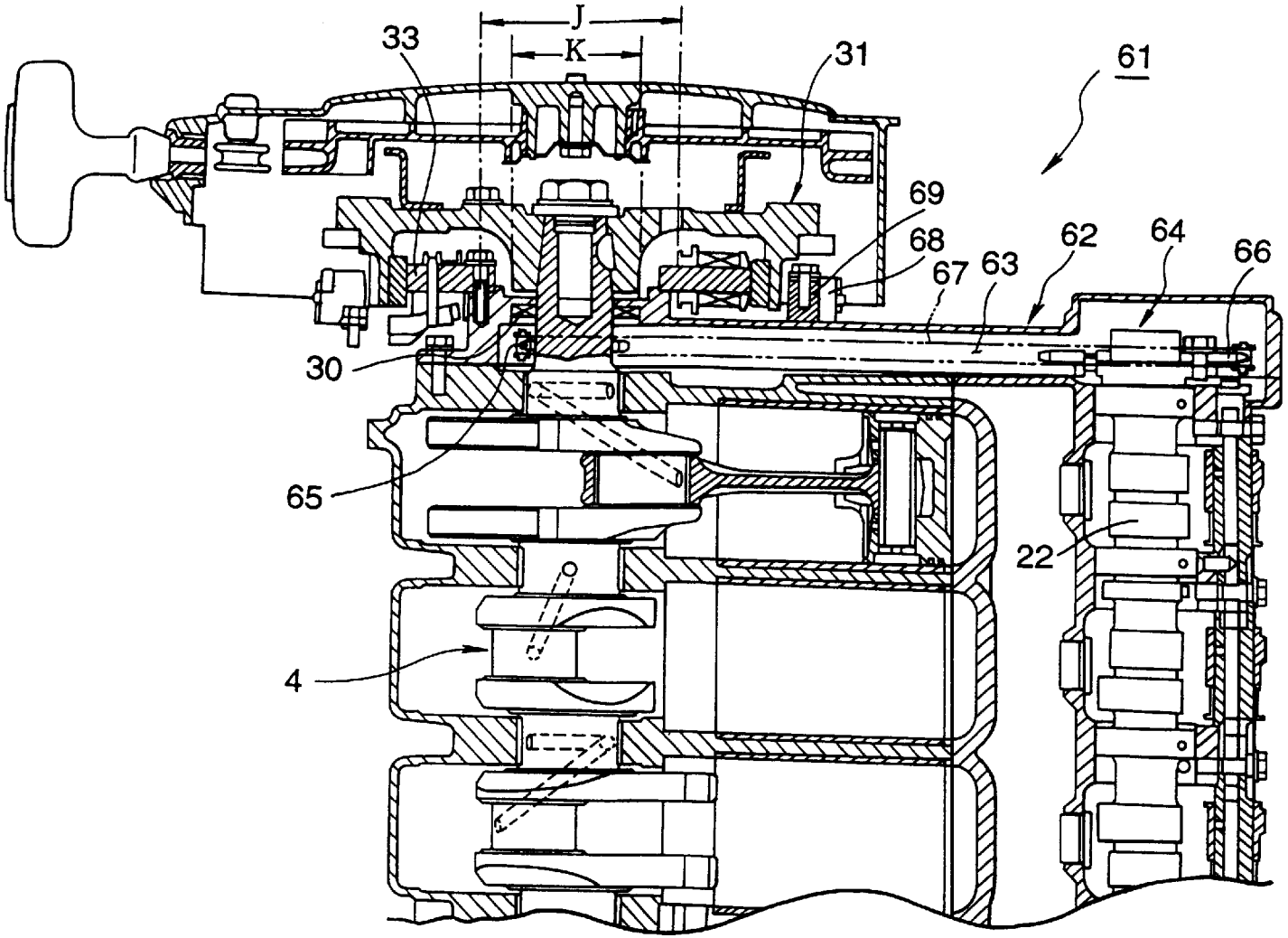
FIG. 8 is an enlarged side view of an upper portion of the engine of the outboard motor showing a second embodiment according to the present invention.

FIG. 8 is an enlarged side view of an upper portion of an engine of an outboard motor showing a second embodiment to which the present invention is applied. Constituent members similar to those of the engine 3 shown in the first embodiment are designated by the same reference numerals and its explanation will be omitted herein.

As shown in FIG. 8, an engine (engine unit having an engine body) 61 has basically the same structure as that of the engine 3 shown in the first embodiment except for the placement of the cam shaft driving mechanism 24 of the first embodiment. In the second embodiment, the engine 61 is provided at its upper portion with a chain cover 62, and a cam chain chamber 63 is formed in the chain cover 62. A cam shaft driving mechanism 64 for transmitting the rotation of the crankshaft 4 to the cam shaft 22 to rotate the cam shaft 22 is provided in the cam chain chamber 63.

A cam drive sprocket 65 is provided on a portion of the crankshaft 4 projecting upward of the engine 61, and a cam driven sprocket 66 is provided on an upper end of the cam shaft 22 projecting upward of the engine 61. A timing chain 67 is wound around these sprockets 65 and 66.

The chain cover 62 also serves as a supporting member of the oil seal 30, and further serves as a mounting member of the stator 33 constituting the magneto device 31 and includes a boss 69 for mounting the crank angle detecting sensor 68. A diameter J of the mounting portion of the stator 33 to the chain cover 62 is set greater than an outer diameter K of the oil seal 30 as in the first embodiment, and the stator 33 is disposed outside of the oil seal 30. Further, the sensor mounting boss 69 is arranged such that the sensor 68 can be mounted upside down as in the first embodiment.

The operation of the second embodiment of the present invention will be explained.

The cam shaft driving mechanism 64 is provided the upper portion of the engine 61, and the chain cover 62 for covering the cam shaft driving mechanism 64 also functions as the mounting member of the stator 33, and as a boss 69 for mounting the crank angle detecting sensor 68. Therefore, it is possible to largely reduce the number of parts.

Further, if the diameter of the mounting portion of the stator 33 to the chain cover 62 is set greater than the outer diameter of the oil seal 30 as in the first embodiment, the same operation and effect can be obtained.

It is to be noted that the present invention is not limited to the described embodiments and many other changes and modifications may be made without departing from the scope of the appended claims.

What is claimed is:

1. An engine unit of an outboard motor comprising:

an engine body;

a crank case in which a crankshaft is vertically perpendicularly arranged in a mounted state of the outboard motor;

a cylinder block which is disposed at a rear side of the crank case and in which cylinders are arranged;

a cylinder head disposed at a rear side of the cylinder block, said crank case, said cylinder block and said cylinder head being disposed in the engine body;

a magnet device mounted at a top end portion of the crankshaft projecting upward and comprising a stator and a flywheel to which a rotor is integrally formed, a bearing boss disposed at a mating portion of said cylinder block and said crank case;

a bearing boss wherein said crankshaft is supported by said bearing boss and said bearing means;

an oil seal disposed between the bearing boss and the bearing means, said magnet device being mounted to the engine body through said stator through a mounting portion, wherein a diameter of said mounting portion of the stator is larger than an outer diameter of said oil seal; and a crank angle detecting sensor disposed at an upper surface of the engine body and a mounting boss for mounting said sensor so as to be deviated sideways from a center line of the cylinder of the engine body, said sensor being mounted to said mounting boss in an upside-down manner.

2. An engine unit of an outboard motor according to claim 1, wherein said stator is directly mounted to said engine body.

3. An engine unit of an outboard motor according to claim 2, wherein said engine body is formed with a hole through which the stator is mounted and said hole has a depth deeper than a position of a mounting portion of said oil seal.

4. An engine unit of an outboard motor according to claim 1, further comprising a cam shaft driving mechanism which is disposed below said bearing means.

5. An engine unit of an outboard motor comprising:

an engine body;

a crank case in which a crankshaft is vertically perpendicularly arranged in a mounted state of the outboard motor;

a cylinder block which is disposed at a rear side of the crank case and in which cylinders are arranged;

a cylinder head disposed at a rear side of the cylinder block, said crank case, said cylinder block and said cylinder head being disposed in the engine body;

a magnet device mounted at a top end portion of the crankshaft projecting upward and comprising a stator and a flywheel to which a rotor is integrally formed, a bearing boss disposed at a mating portion of said cylinder block and said crank case;

a bearing boss wherein said crankshaft is supported by said bearing boss and said bearing means;

an oil seal disposed between the bearing boss and the bearing means, said magnet device being mounted to the engine body through said stator through a mounting portion, wherein a diameter of said mounting portion of the stator is larger than an outer diameter of said oil seal; and a starter motor, a motor boss for mounting the starter motor to the engine body, a boss connected to said starter motor mounting boss and a crank angle detecting sensor which is mounted to said boss connected to said starter motor mounting boss.

6. An engine unit of an outboard motor according to claim 5, wherein said stator is directly mounted to said engine body.

7. An engine unit of an outboard motor according to claim 5, wherein said engine body is formed with a hole through which the stator is mounted and said hole has a depth deeper than a position of a mounting portion of said oil seal.

8. An engine unit of an outboard motor according to claim 5, further comprising a cam shaft driving mechanism which is disposed below said bearing means.

* * * * *